US007261437B2

(12) United States Patent
Coushaine et al.

(10) Patent No.: US 7,261,437 B2
(45) Date of Patent: Aug. 28, 2007

(54) WEDGE-BASED LAMP WITH LED LIGHT ENGINE AND METHOD OF MAKING THE LAMP

(75) Inventors: Charles M. Coushaine, Rindge, NH (US); Steve C. Sidwell, Hopkington, NH (US); Thomas Tessnow, Weare, NH (US); Robert H. Colburn, Groveland, MA (US)

(73) Assignee: Osram Sylvania Inc., Danvers, MA (US)

( * ) Notice: Subject to any disclaimer, the term of this patent is extended or adjusted under 35 U.S.C. 154(b) by 80 days.

(21) Appl. No.: 10/864,988

(22) Filed: Jun. 10, 2004

(65) Prior Publication Data

US 2005/0276063 A1 Dec. 15, 2005

(51) Int. Cl.
*F21V 14/00* (2006.01)
*F21V 21/00* (2006.01)

(52) U.S. Cl. ..... 362/255; 362/545; 362/548; 362/549; 362/640; 362/652; 362/234; 362/310; 362/800

(58) Field of Classification Search ..... 362/255, 362/294, 800, 555, 487, 545, 548, 549, 226, 362/234, 240, 254, 310, 810, 540, 251, 640, 362/652

See application file for complete search history.

(56) References Cited

U.S. PATENT DOCUMENTS 5,160,200 A * 11/1992 Cheselske ..... 362/249
6,357,902 B1 * 3/2002 Horowitz ..... 362/545
6,371,636 B1 * 4/2002 Wesson ..... 362/545
6,580,228 B1 * 6/2003 Chen et al. ..... 315/185 R
6,598,996 B1 * 7/2003 Lodhie ..... 362/249
6,727,652 B2 * 4/2004 Sivacumarran ..... 315/58
6,737,811 B2 * 5/2004 Zhang et al. ..... 315/56
6,803,607 B1 * 10/2004 Chan et al. ..... 257/98
6,827,469 B2 * 12/2004 Coushaine et al. ..... 362/294
6,880,962 B2 * 4/2005 Coushaine et al. ..... 362/555
2004/0156213 A1 * 8/2004 Lodhie ..... 362/555
2004/0201990 A1 * 10/2004 Meyer ..... 362/255
2005/0030761 A1 * 2/2005 Burgess ..... 362/555

* cited by examiner

*Primary Examiner*—Jong-Suk (James) Lee
*Assistant Examiner*—Jacob Y Choi
(74) *Attorney, Agent, or Firm*—William E. Meyer

(57) ABSTRACT

An LED wedge-based lamp and method of making the lamp, where the lamp has a generally planar circuit board having one end that has electrical connections exposed thereon and a connecting part that is adapted to mechanically couple the lamp to a wedge-based lamp socket. The lamp includes an LED light engine near a second end of the circuit board, where the light engine includes plural laterally aligned LEDs whose light output mimics the light output of an incandescent lamp, such as used in automobile stop and turn signals. The lamp includes a load resistor, whose load mimics that of the incandescent lamp, on an exterior surface of the connecting part. The connecting part may be a sleeve that slides onto the circuit board. A hand grip/heat sink may be provided at the second end of the circuit board.

21 Claims, 6 Drawing Sheets

WEDGE-BASED LAMP WITH LED LIGHT ENGINE AND METHOD OF MAKING THE LAMP

BACKGROUND OF THE INVENTION

The present invention is directed to a novel lamp that can replace a conventional incandescent lamp, such as the miniature incandescent lamp used in automobile stop and tail signals. These incandescent lamps have a standard bulb shape, such as an S8 bulb shape, and a standard base, such as a bayonet or wedge base. The present invention is directed to a novel wedge-based lamp that fits in the socket used by a conventional wedge-based incandescent lamp, such as the S8 wedge-based lamp sold by Osram Sylvania.

A conventional incandescent lamp with a wedge base is shown in FIG. 1. The lamp 10 includes a conventional incandescent bulb 12 and a base part 14 that has faces and fittings 16 that are arranged to mechanically couple the lamp to a wedge-based lamp socket (not shown). An end 18 of the base part 14 includes electrical connections 20 suitable for wedge-based lamp sockets and that lead to the filament in the incandescent bulb 12.

Incandescent lamps are ubiquitous, despite the problems of filament life, bulb breakage and manufacturing issues. A suitable replacement has long been sought that can avoid at least some of these problems; particularly where replacement is complex such as in automobile light fixtures.

Light emitting diodes (LEDs) have long been known as a source of light for visual displays, photoelectronic systems and electro-optical components. LEDs are semiconductor pn-junction radiation sources that emit spontaneous radiation in the visible range. Temperature is a primary stress parameter for LEDs and they should be kept below a defined temperature, say 105° C., for reliable operation. One of the problems with using LEDs as replacements for incandescent lamps has been the heat generated when providing an amount of light equivalent to an incandescent lamp, and the management of that heat in a package that is equivalent in size to the incandescent lamp. This heat problem is exacerbated in some applications by the need to simulate a larger electrical load that is equivalent to that of the incandescent lamp being replaced.

SUMMARY OF THE INVENTION

An object of the present invention is to provide a novel non-incandescent lamp that avoids the problems of the prior art.

A further object of the present invention is to provide a novel lamp with a wedge base that uses an LED light engine.

A yet further object of the present invention is to provide a novel lamp that includes a generally planar circuit board having a base that is adapted to fit into a wedge-based lamp socket and a light engine at an opposite end of the circuit board, where the light engine includes at least one LED mounted on the circuit board.

Another object of the present invention is to provide a novel lamp that includes a circuit board having a base connection that is adapted to mechanically couple the lamp to a wedge-based lamp socket, a light engine with plural LEDs, and a circuit connected to the light engine that includes a load resistor on an exterior surface of the base connection.

Yet another object of the present invention is to provide a novel method of making a lamp with a wedge base, which includes the steps of attaching electrical connections to a generally planar circuit board, mounting a light engine having plural LEDs on the circuit board, attaching a connecting part to the circuit board where the connecting part is adapted to mechanically couple the lamp to a wedge-based lamp socket, and attaching a load resistor to an exterior surface of the connecting part where the load resistor is spaced from the circuit board and electrically connected to the LED light engine.

These and other objects and advantages of the invention will be apparent to those of skill in the art of the present invention after consideration of the following drawings and description of preferred embodiments.

DESCRIPTION OF PREFERRED EMBODIMENTS

Figure 2:
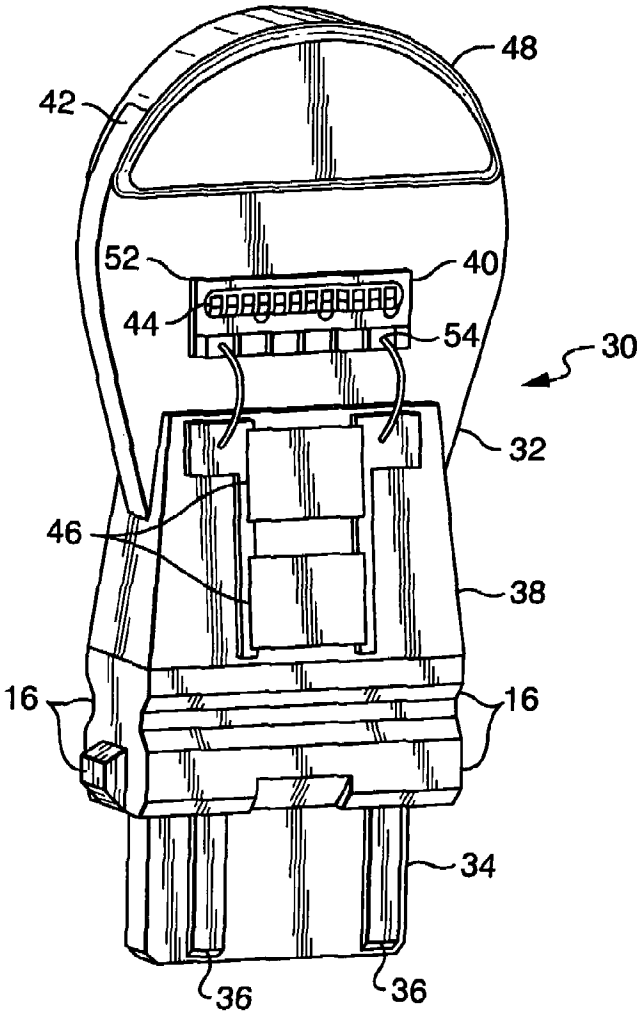
FIG. 2 is a pictorial depiction of a first embodiment of the lamp of the present invention.
Figure 1:
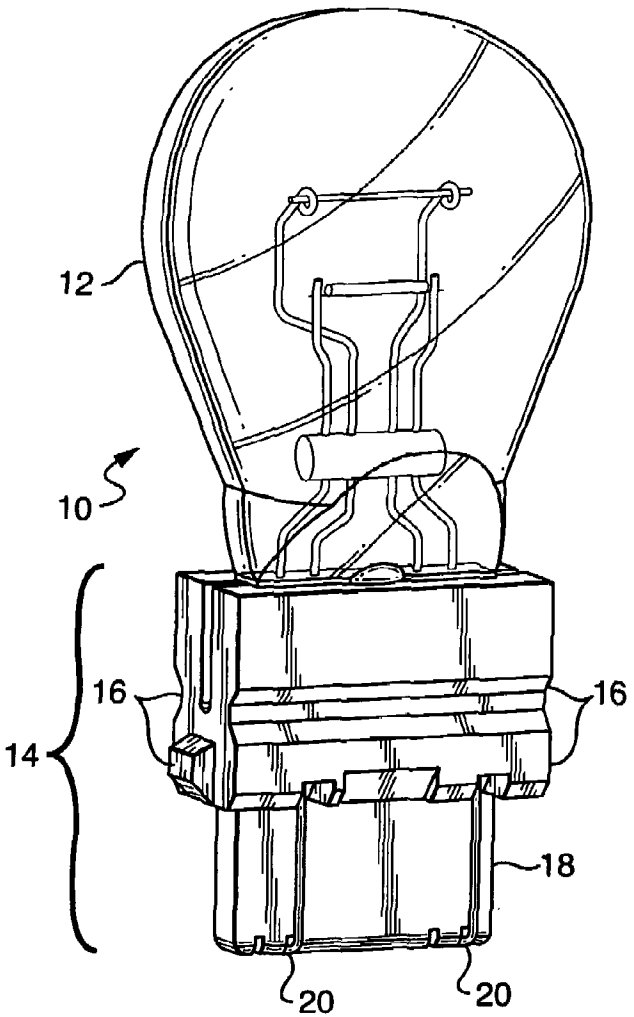
FIG. 1 (PRIOR ART)
FIG. 1 is a pictorial depiction of a conventional incandescent lamp with a wedge base.

With reference now to FIG. 2, one embodiment of the present invention is a lamp 30 with a wedge base that includes a generally planar circuit board 32 having one end 34 that has electrical connections 36 exposed thereon and a connecting part 38 that is adapted to mechanically couple the lamp to a wedge-based lamp socket, such as by including the fittings 16. The lamp 30 includes an LED light engine 40 near a second end 42 of the circuit board, where the light engine includes one or more LEDs 44 whose light output mimics the light output of an incandescent lamp, such as used in automobile stop and turn signals. The lamp 30 includes a load resistor 46, whose load mimics that of the incandescent lamp, on an exterior surface of the connecting part 38. The connecting part 38 may be a sleeve that slides onto the circuit board 32. A hand grip/heat sink 48 may be provided at the second end 42 of the circuit board 32.

The one end 34 of circuit board 32 is arranged and adapted to fit into a wedge-based lamp socket (not shown) and the electrical connections 36 thereon are located in correspondence with electrical connections in the socket. The electrical connections 36 may be tin, brass, copper or similar metal contacts that extend from the bottom edge of the circuit board 32 to connections for the light engine 40. The shape of the top of the circuit board 32 may vary as needed to accommodate the light engine 40. FIG. 2 shows that the circuit board 32 has a wider portion at the second end 42 to provide room for the LEDs 44, and other shapes are possible. The circuit board 32 is preferably heat conductive, and may be a metal substrate such as provided by The Berquist Company under the mark Thermal Clad Insulated Metal Substrate. These substrates minimize thermal impedance and conduct heat more effectively than standard printed wiring boards. They include a base layer of aluminum or other suitable metal, a dielectric layer on the base layer and a printed circuit layer on the dielectric layer.

The light engine 40 includes a sufficient number of LEDs 44 to substantially duplicate the incandescent lamp being replaced or as necessary for a particular application. The LEDs 44 may be conventional and are preferably aligned in a row near a middle of the top of the circuit board 32 to mimic the filament of an incandescent lamp, although other arrangements are possible. The LEDs 44 may be mounted on one or both sides of the circuit board 32 and may be carried on a further board 52 for ease of manufacture. Placing the LEDs 44 on both sides allows the lamp to be used in either direction.

The connecting part 38 is preferably a thermal insulator, such as a ceramic, that is mechanically coupled to the circuit board 32 using conventional attachments such as adhesive, screws or pins. When the connecting part 38 is attached to the circuit board 32, the combination of the connecting part 38 and end 34 of the circuit board 32 forms the wedge base for the lamp. While the figures show that the connecting part 38 is adapted to mechanically couple the lamp to a wedge-based lamp socket by including the fittings 16, other fittings that fit a particular type of socket are possible.

The connecting part 38 may be hollow and slide onto the circuit board 32, or may be two parts that fit on opposite sides of the circuit board 32. The load resistor 46 is preferably on one or both sides of an exterior of the connecting part 38, although other arrangements are possible in which the load resistor is separated from the circuit board 32 by a thermal insulator to isolate the heat of the load resistor 46 from the circuit board 32. The load resistor 46 may include two planar resistors that are connected in parallel to circuitry that connects the light engine 40 to the electrical connections 36. The load resistor 46 provides a load that simulates a load of a corresponding incandescent lamp and may be sized appropriately. A protective coating (not shown), such as silicon or epoxy material, may be applied to the load resistors 46 and circuitry on the circuit board 32.

The hand grip/heat sink 48 is optional and may be provided either as a grip for grasping the lamp or as a heat sink for the circuit board 32, or both. The embodiment shown in the figures includes tapered sides to facilitate grasping the lamp and is made of a suitable heat conducting metal such as zinc, copper or aluminum. The hand grip/heat sink 48 may also include fins (not shown) or other conventional heat sink features.

Figure 3:
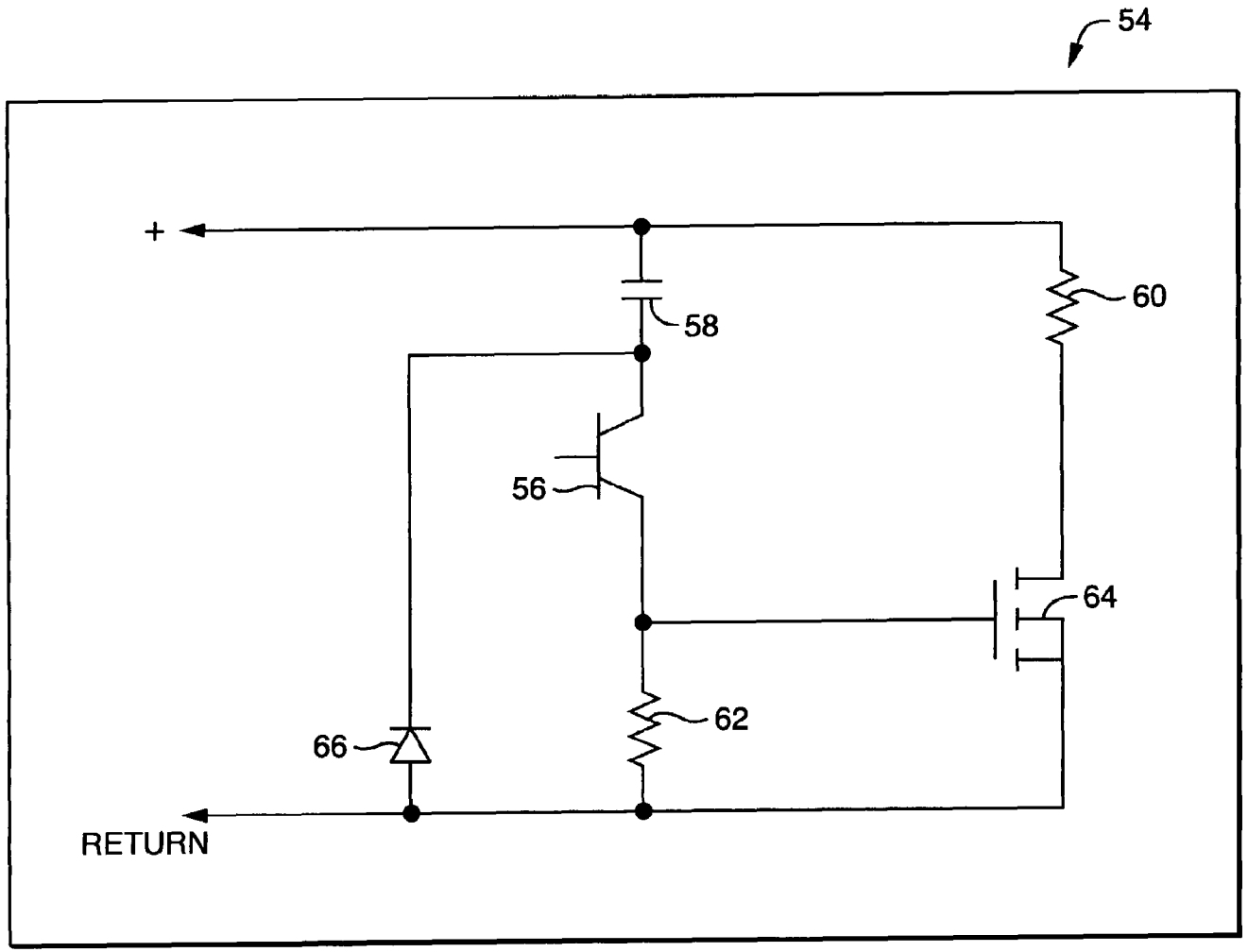
FIG. 3 is a circuit diagram of a ballast circuit for the lamp of the present invention.
Figure 4:
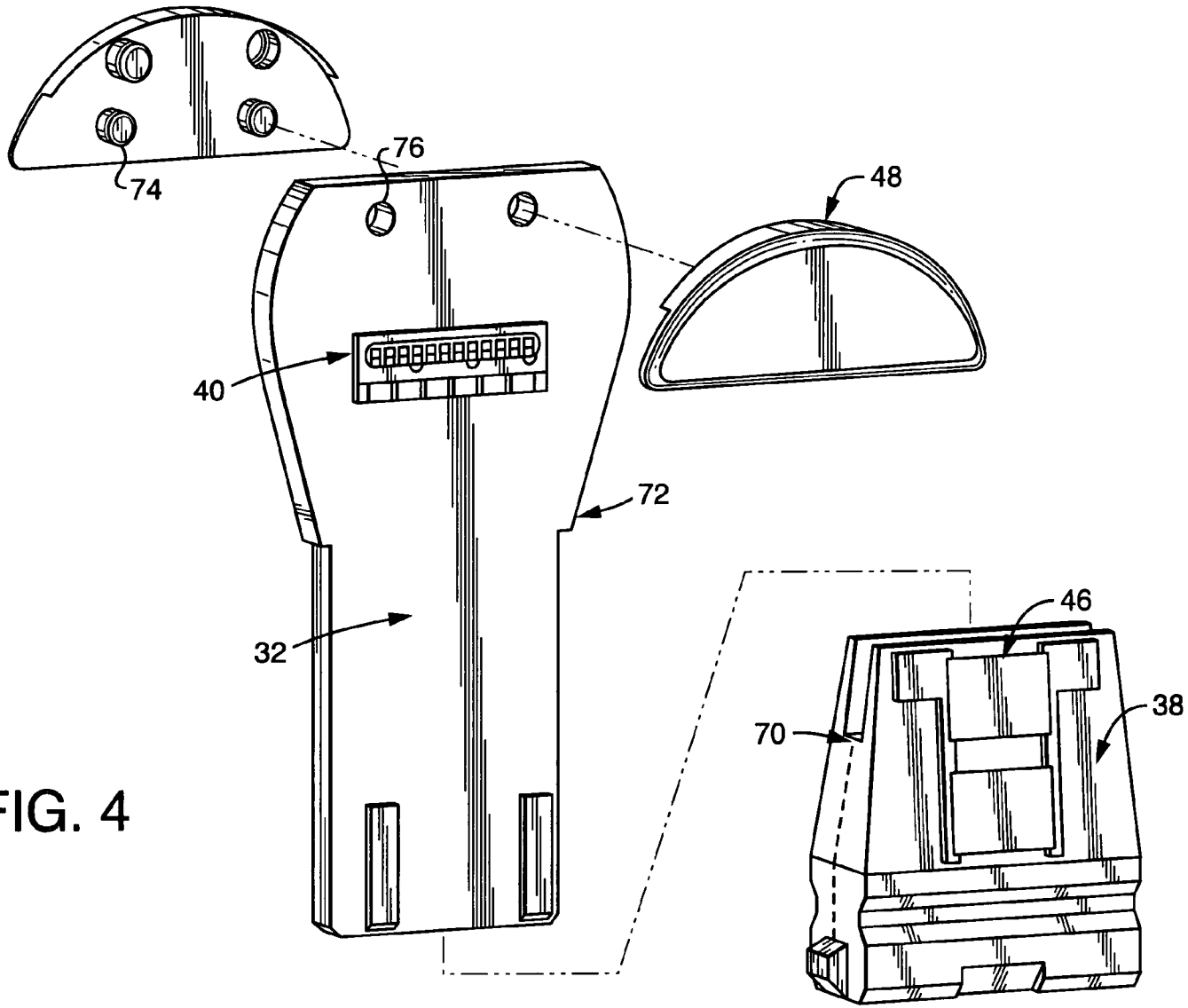
FIG. 4 is an exploded view illustrating a method of manufacturing the lamp of the present invention.
Figure 5A:
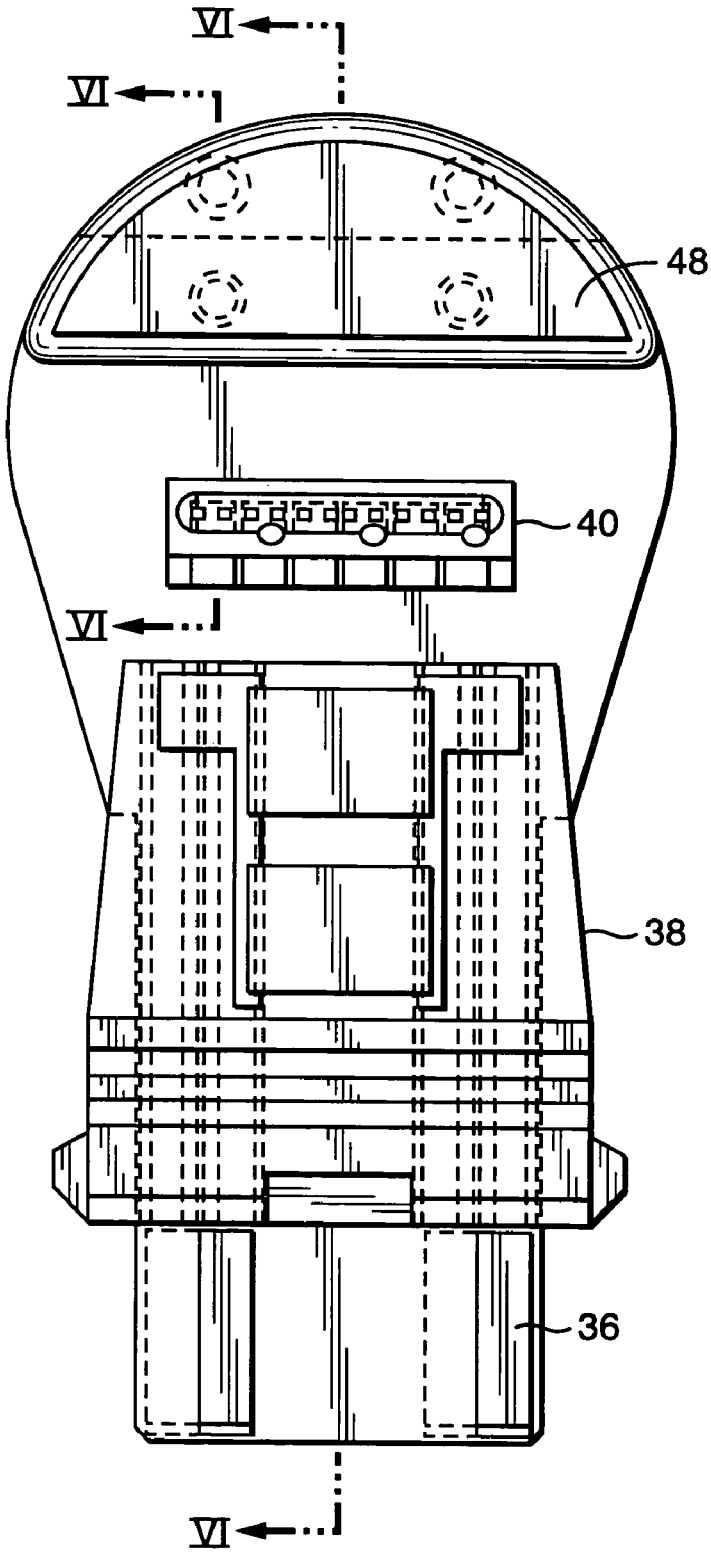
FIGS. 5*a-c* are front, top and bottom views, respectively, of an embodiment of the lamp of the present invention.
Figure 5B:
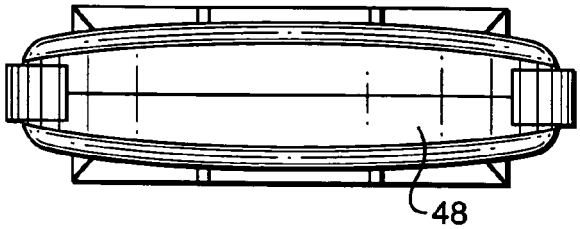
Figure 5C:
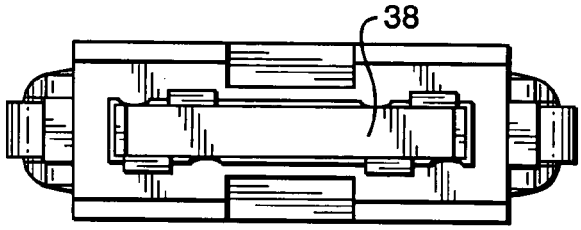
Figure 6:
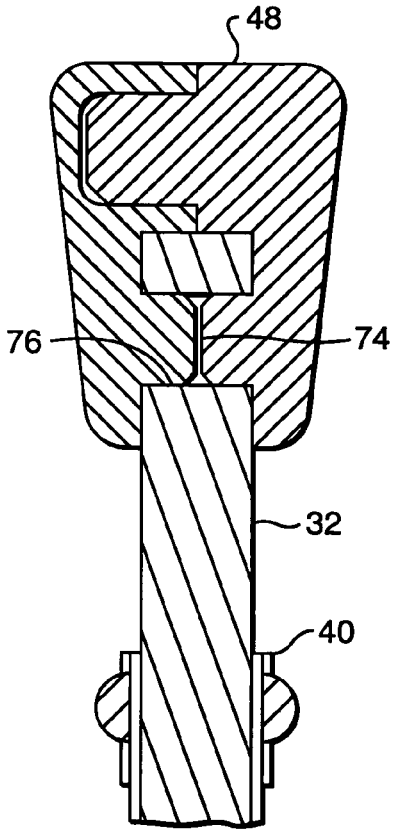
FIG. 6 is a partial sectional view through line VI-VI of FIG. 5*a*.

With reference to FIGS. 2-3, the lamp 30 may also include a ballast circuit 54 connecting the light engine 40 to the electrical connections 36 and load resistor 46. The ballast circuit may be integral with the light engine 40, such as on the further board 52. The ballast circuit 54 may include a phototransistor 56 that is optically coupled to the light engine 40, a capacitor 58, a ballast resistor 60, a first resistor 62, a field effect transistor (FET) 64, and a diode 66. The capacitance of capacitor 58, a resistance of first resistor 62 and a gate turn-on threshold voltage of the FET 56 can be set to define ON-OFF cycle times of the lamp.

In operation, when power is applied to the lamp and the LEDs emit light, the phototransistor 56 (recall that it is optically coupled to the LEDs) goes into a low impedance conduction state. This completes the circuit between the + and return through the capacitor 58, phototransistor 56 and first resistor 62. Since the capacitor 58 was fully discharged prior to application of voltage at the + terminal, the voltage at the gate of the FET 64 immediately rises to the voltage at the + terminal, turning ON the FET 64 and consequently completing the circuit for the ballast resistor 60, whose resistance may be set at an appropriate amount, such as 10 ohm. At the same time, the capacitor 58 is charging because the circuit through the phototransistor 56 is complete. As the capacitor 58 charges, the voltage at the gate of the FET 64 decreases. After a time determined by the capacitance of the capacitor 58, resistance of the first resistor 62 and gate turn-on threshold voltage of the FET 64, the FET 64 will cease to conduct resulting in the removal of the conduction path for the ballast resistor 60. The period during which the ballast resistor 60 is connected can be set to a desired time, such as for an ON-OFF cycle of a conventional automobile turn signal. Thereafter, when the voltage is removed from the + terminal, the capacitor 58 is discharged through the path provided by the diode 66 and the impedance of the external circuit (not shown) connected to the + terminal. If this impedance is not low enough to fully discharge the capacitor during the OFF time of a normal flashing cycle, a further resistor can be added to the circuit.

An advantage of this arrangement of circuit 54 is that if the LEDs do not light when voltage is applied to the + terminal, the ballast resistor 60 will not be connected and there will not be sufficient current drawn by the lamp to activate the conventional "good lamp" detection circuits in an automobile. A further advantage is that if the voltage at the + terminal remains longer than the time set by the circuit to disconnect the ballast resistor 60, the ballast resistor 60 will disconnect and remain disconnected until the voltage is removed from the + terminal and the circuit 54 is returned to its initial condition. The components of circuit 54 are sufficiently small to fit on the further board 52 of the light engine 40.

Figure 7:
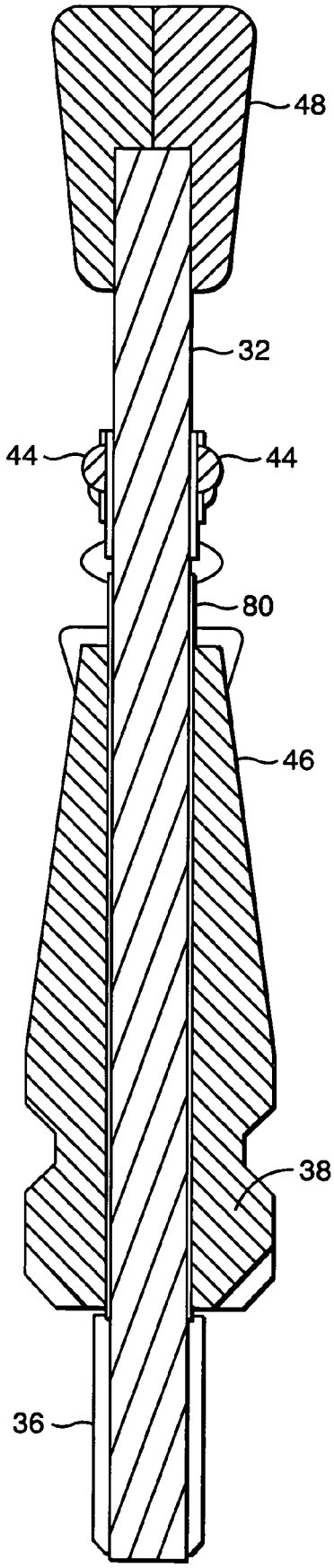
FIG. 7 is a sectional view through line VII-VII of FIG. 5*a*.

A method of making the lamp will now be described with reference to FIGS. 4-5*a-c*, 6 and 7, in which the same element numbers as FIG. 2 have been used for corresponding features. The connecting part 38 may slide onto circuit board 32 by placing the circuit board 32 into the hollow 70 in connecting part 38. The connecting part 38 slides into a position defined by a notch 72 on an edge of the circuit board 32. Alternatively, connecting part 38 may be in two pieces (the dashed line on the side of element 38 in FIG. 4 defines a possible division of the connecting part) and fit on opposite sides of the circuit board 32. The further board 52, if used, may be attached to the circuit board 32 with a thermally conductive adhesive. Suitable circuitry for connecting the electrical connections 36 to the load resistor 46 and light engine 40 (some of which shown in FIG. 5*a* in dashed lines), including printed circuit traces, may be conventionally applied on the surface of the circuit board 32. The load resistor 46 may be applied to the exterior of the connecting part 38 by painting or other suitable methods of application of a planar resistor. The load resistor 46 may include two separate painted areas that are connected in parallel by suitable printed or other circuitry. The hand grip/heat sink 48 may be applied in two parts (as shown also shown in FIG. 6) and have projections 74 that correspond to holes 76 in the circuit board. The two parts may be press fit together. Thereafter, as shown FIG. 7, the LEDs 44, load resistor 46 and electrical connections 36 are electrically connected to each other with suitable connectors such as flying leads, spring contacts, solder, clips, jump wires, and the like. Jump wires 78 are shown in FIG. 7, by way of example. Further circuitry 80 may be provided on the circuit board 32 instead of or in addition to the jump wires.

While embodiments of the present invention have been described in the foregoing specification and drawings, it is to be understood that the present invention is defined by the following claims when read in light of the specification and drawings.

What is claimed is:

1. A lamp with a wedge base, comprising:

a generally planar circuit board having a base end that is arranged and adapted to fit into a wedge-based lamp socket and that has electrical connections thereon;

a light engine near a top end of said circuit board opposite said base end, said light engine comprising at least one light emitting diode (LED) mounted on said circuit board and that is connected to said electrical connections; and a load reduction resistor electrically connected intermediate the light engine and the electrical connections, and spaced from the planar circuit board, and further comprising a sleeve mechanically coupled to said base end so that said electrical connections are exposed at a distal end of said base end, said sleeve being arranged and adapted to mechanically couple the lamp to a wedge-based lamp socket; and wherein the load resistor is on an exterior surface of said sleeve, said load resistor being electrically connected between said light engine and said electrical connections.

2. The lamp of claim 1, wherein said load resistor comprises a pair of planar resistors that each coats a different part of the exterior surface of said sleeve.

3. A lamp with a wedge base, comprising:

a generally planar circuit board having a base end that is arranged and adapted to fit into a wedge-based lamp socket and that has electrical connections thereon;

a light engine near a top end of said circuit board opposite said base end, said light engine comprising at least one light emitting diode (LED) mounted on said circuit board and that is connected to said electrical connections; and a load reduction resistor electrically connected intermediate the light engine and the electrical connections, and spaced from the planar circuit board, and further comprising a sleeve mechanically coupled to said base end so that said electrical connections are exposed at a distal end of said base end, said sleeve being arranged and adapted to mechanically couple the lamp to a wedge-based lamp socket; and wherein said circuit board has a side with a notch therein, and wherein said sleeve engages said notch to define a position of said sleeve on said circuit board.

4. A lamp with a wedge base, comprising:

a generally planar circuit board having a base end that is arranged and adapted to fit into a wedge-based lamp socket and that has electrical connections thereon;

a light engine near a top end of said circuit board opposite said base end, said light engine comprising at least one light emitting diode (LED) mounted on said circuit board and that is connected to said electrical connections; and a load reduction resistor electrically connected intermediate the light engine and the electrical connections, and spaced from the planar circuit board wherein said light engine comprises a plurality of LEDs, and wherein said plurality of LEDs is mounted on opposite sides of said circuit board.

5. A lamp, comprising:

a circuit board having a base connection that is arranged and adapted to mechanically couple said lamp to a lamp socket and that has electrical connections thereon;

a light engine near an end of said circuit board opposite said base connection, said light engine comprising plural light emitting diodes (LEDs) mounted on said circuit board;

a circuit connecting said light engine to said electrical connections, said circuit comprising a load resistor on an exterior surface of said base connection, and the resistor spaced from the circuit board.

6. The lamp of claim 5, wherein said circuit further comprises a ballast circuit that includes a phototransistor that is optically coupled to said light engine, a capacitor, a first resistor connected in series with said capacitor and said phototransistor, and a field effect transistor (FET) and a ballast resistor that are connected in parallel with said phototransistor, and wherein a capacitance of said capacitor, a resistance of said first resistor and a gate turn-on threshold voltage of said FET define ON-OFF cycle times of the lamp.

7. The lamp of claim 5, wherein said base connection comprises a fitting with faces aligned to mechanically couple with a wedge-based lamp socket.

8. A lamp with a wedge base, comprising:

a generally planar, longitudinally extended, circuit board having one longitudinal end that has electrical connections exposed thereon;

a light engine near a second longitudinal end of said circuit board opposite said one longitudinal end, said light engine comprising plural laterally aligned light emitting diodes (LEDs) mounted on said circuit board;

a connecting part at said one longitudinal end that is arranged and adapted to mechanically couple said lamp to a wedge-based lamp socket; and a load resistor on an exterior surface of said connecting part, said load resistor being spaced from said circuit board and electrically connected to said light engine and said electrical connections.

9. The lamp of claim 8, further comprising a heat sink attached to a distal portion of said second longitudinal end of said circuit board, wherein said plural LEDs are exposed between said heat sink and said connecting part.

10. The lamp of claim 9, wherein said heat sink comprises tapered sides for grasping the lamp.

11. The lamp of claim 9, wherein said heat sink comprises two halves with said distal portion of said second longitudinal end of said circuit board between said two halves.

12. The lamp of claim 8, wherein said load resistor comprises two planar resistors that each coats a different part of the exterior surface of said connecting part.

13. The lamp of claim 12, wherein said pair of planar resistors are connected in parallel.

14. The lamp of claim 8, wherein said load resistor has a resistance that corresponds to a load of an incandescent lamp having a light output equivalent to a light output of said plural LEDs.

15. A method of making a lamp with a wedge base, comprising the steps of:

attaching electrical connections to a generally planar, longitudinally extended, circuit board;

mounting a light engine on the circuit board, the light engine including plural light emitting diodes (LEDs);

attaching a connecting part to the circuit board with the electrical connections exposed at an end of the circuit board, the connecting part and the end of the circuit board with the exposed electrical connections being arranged and adapted to mechanically couple the lamp to a wedge-based lamp socket; and attaching a load resistor to an exterior surface of the connecting part so that the load resistor is spaced from the circuit board and electrically connects the load resistor to the light engine and the electrical connections.

16. The method of claim 15, wherein the connecting part is hollow and the step of attaching the connecting part comprises the steps of sliding the circuit board into the hollow connecting part and mechanically coupling the connecting part to the circuit board.

17. The method of claim 16, wherein the circuit board has a side with a notch therein, and wherein the sliding step includes sliding the connecting part onto the circuit board into engagement with the notch to define a position of the connecting part on the circuit board.

18. The method of claim 15, wherein the connecting part includes two parts and the step of attaching the connecting part comprises the steps of fitting the circuit board between the two parts and mechanically coupling the connecting part to the circuit board.

19. The method of claim 15, wherein the step of attaching the load resistor comprises the step of applying two planar resistors to different areas of the exterior surface of the connecting part.

20. The method of claim 15, further comprising the step of attaching a heat sink to an edge of the circuit board, the heat sink having tapered sides to facilitate grasping the lamp.

21. The method of claim 20, wherein the step of attaching the heat sink includes pressing together two halves of the heat sink over a hole in the circuit board.

* * * * *